US009188895B2

(12) United States Patent
Farrugia et al.

(10) Patent No.: US 9,188,895 B2
(45) Date of Patent: Nov. 17, 2015

(54) TONER ADDITIVES FOR IMPROVED CHARGING

(71) Applicant: XEROX CORPORATION, Norwalk, CT (US)

(72) Inventors: Valerie M. Farrugia, Oakville (CA); Kimberly D. Nosella, Mississauga (CA); Richard P. N. Veregin, Oakville (CA); Michael S. Hawkins, Cambridge (CA)

(73) Assignee: XEROX CORPORATION, Norwalk, CT (US)

( * ) Notice: Subject to any disclaimer, the term of this patent is extended or adjusted under 35 U.S.C. 154(b) by 3 days.

(21) Appl. No.: 14/107,667

(22) Filed: Dec. 16, 2013

(65) Prior Publication Data

US 2015/0168861 A1 Jun. 18, 2015

(51) Int. Cl.

| | |
|---|---|
| ***G03G 9/08*** | (2006.01) |
| ***G03G 9/10*** | (2006.01) |
| ***G03G 9/087*** | (2006.01) |

(52) U.S. Cl.

CPC ..... *G03G 9/10* (2013.01); *G03G 9/0804* (2013.01); *G03G 9/08755* (2013.01)

(58) Field of Classification Search

CPC ..... G03G 9/09392; G03G 9/09328; G03G 9/09321; G03G 9/09741; G03G 9/0926; G03G 9/09758; G03G 9/09766; G03G 9/09716

USPC ..... 430/110.2, 108.2, 108.15

See application file for complete search history.

(56) References Cited

U.S. PATENT DOCUMENTS

| | | | | |
|---|---|---|---|---|
| 4,198,477 | A * | 4/1980 | Williams et al. | 430/123.5 |
| 4,295,990 | A | 10/1981 | Verbeek et al. | |
| 4,457,998 | A | 7/1984 | Gruber et al. | |
| 4,636,451 | A * | 1/1987 | Matkin et al. | 430/110.2 |
| 4,935,326 | A | 6/1990 | Creatura et al. | |
| 4,937,166 | A | 6/1990 | Creatura et al. | |
| 5,051,330 | A * | 9/1991 | Alexandrovich et al. | 430/108.2 |
| 5,102,766 | A | 4/1992 | Nanya et al. | |
| 5,290,654 | A | 3/1994 | Sacripante et al. | |
| 5,302,486 | A | 4/1994 | Patel et al. | |
| 5,304,447 | A * | 4/1994 | Svendsen et al. | 430/110.2 |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,556,732 | A | 9/1996 | Chow | |
| 5,585,215 | A | 12/1996 | Ong et al. | |
| 5,650,255 | A | 7/1997 | Ng et al. | |

(Continued)

FOREIGN PATENT DOCUMENTS

| | | | | |
|---|---|---|---|---|
| JP | 2009116049 | * | 5/2009 | G03G 9/097 |

OTHER PUBLICATIONS

Machine English langauge translation of JP 2009116049 May 28, 2009.*

*Primary Examiner* — Hoa V Le

(74) *Attorney, Agent, or Firm* — Pillsbury Winthrop Shaw Pittman LLP

(57) ABSTRACT

Toner additives for improving overall toner charging. In particular, incorporation of fluorinated surfactants into latex for formation of toner core particles provide enhanced charging without any significant adverse impact on the other properties of the toner. Methods of making toners comprising the fluorinated surfactants are also provided.

18 Claims, 4 Drawing Sheets

(56) References Cited

U.S. PATENT DOCUMENTS

| | | | | |
|---|---|---|---|---|
| 5,650,256 | A | 7/1997 | Veregin et al. | |
| 5,716,751 | A * | 2/1998 | Bertrand et al. | 430/137.18 |
| 5,853,943 | A | 12/1998 | Cheng et al. | |
| 6,042,981 | A | 3/2000 | Barbetta et al. | |
| 6,063,827 | A | 5/2000 | Sacripante et al. | |
| 6,355,391 | B1 | 3/2002 | Van Dusen et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,014,971 | B2 | 3/2006 | Skorokhod et al. | |
| 7,524,602 | B2 | 4/2009 | Vanbesien et al. | |
| 7,858,285 | B2 | 12/2010 | Sacripante et al. | |
| 8,338,071 | B2 | 12/2012 | Qiu et al. | |
| 2007/0254229 | A1 | 11/2007 | Patel et al. | |
| 2011/0318053 | A1 * | 12/2011 | Yamashita et al. | 399/112 |

* cited by examiner

TONER ADDITIVES FOR IMPROVED CHARGING

CROSS-REFERENCE TO RELATED APPLICATIONS

This application is related to commonly owned U.S. patent application Ser. No. 14/108,028 to Valerie Farrugia et al., filed Dec. 16, 2013, which is hereby incorporated by reference in its entirety.

BACKGROUND

The present disclosure relates to toners and processes useful in providing toners suitable for electrophotographic apparatuses, including apparatuses such as digital, image-on-image, and similar apparatuses. In particular, the disclosure relates to toner additives, namely, a fluorinated surfactant to improve toner charging. The term "fluorinated surfactant" and "fluorosurfactant" will be used interchangeably. The incorporation of such additives into toners, in particular, emulsion aggregation (EA) toners, have provided improved charging without any significant adverse impact on the other properties of the toner.

In embodiments, the surfactant is incorporated into the latex at the emulsion polymerization stage of the EA process. By doing so, the surfactant is better distributed and retained in the toner core. The surfactant boosts charging, which improves the overall parent charge, charge maintenance and blocking performance of the toner. In addition, the low foaming surfactant reduces the coarse generation in the downstream processing, such as toner making and washing; thus improving the overall yield.

Numerous processes are within the purview of those skilled in the art for the preparation of toners. Emulsion aggregation is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

In general, toners comprise at least a binder resin, a colorant and one or more additives, including external surface additives. Any resin binder suitable for use in toner preparation may be employed without limitation. The properties of a toner are influenced by the materials and amounts of the materials of the toner.

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

As with all toner designs there is a constant need for new methods or chemicals that can improve the overall toner charging performance.

SUMMARY

The present embodiments provide a toner composition comprising: toner particles having a core, wherein the core comprises one or more polyester resins, a colorant, a wax, and one or more additives incorporated into the core, the one or more additives comprising a fluorinated surfactant.

In specific embodiments, there is provided a developer comprising: a toner composition; and a toner carrier, wherein the toner composition comprises toner particles having a core, wherein the core comprises one or more polyester resins, a colorant, a wax, and one or more additives incorporated into the core, the one or more additives comprising a fluorinated surfactant.

In yet other embodiments, there is provided a method of making a toner composition comprising generating a first latex emulsion comprising one or more polyester resins, water and a fluorinated surfactant; generating a colorant dispersion comprising a colorant, water and an ionic or nonionic surfactant; blending the first latex emulsion and colorant dispersion together with an optional wax to form a slurry; adding a coagulant to the slurry; heating the slurry to a temperature below or about equal to the glass transition temperature (Tg) of the amorphous polyester resin to form aggregated particles; adding a second latex emulsion comprising an amorphous polyester resin suspended in an aqueous phase to the aggregated particles to form a shell over the aggregated particles; freezing aggregation of the aggregated particles in the slurry at a desired aggregated particle size; and further heating the aggregated particles in the slurry to a temperature about equal to or above the glass transition temperature (Tg) of the amorphous polyester resin to coalesce the aggregated particles into toner particles.

BRIEF DESCRIPTION OF THE DRAWINGS

For a better understanding of the present embodiments, reference may be had to the accompanying figures.

DETAILED DESCRIPTION

Figure 1:
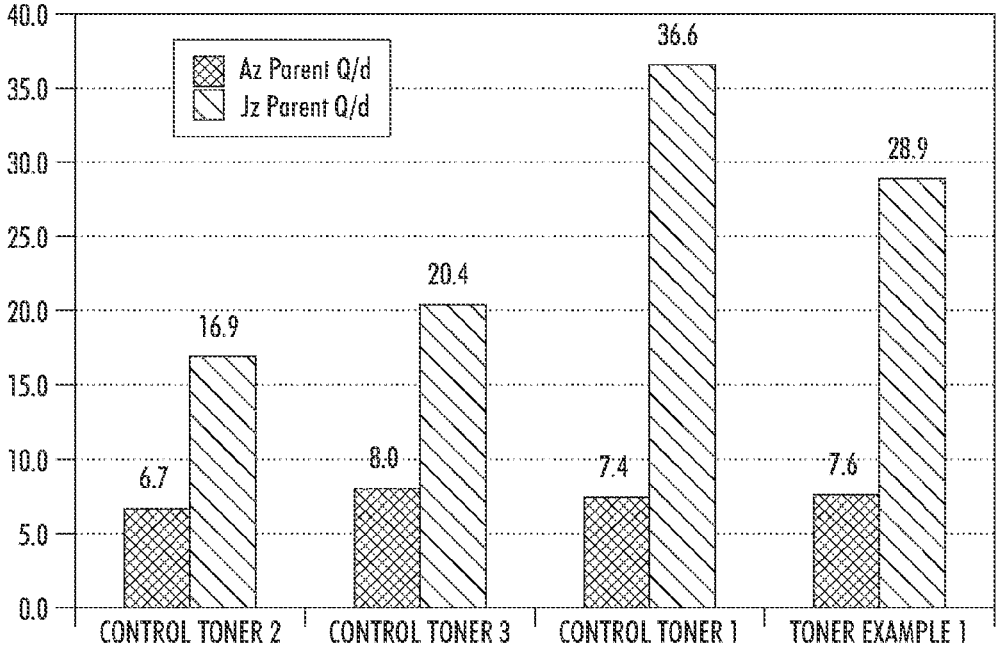
FIG. 1 is a graph illustrating parent charging of control toners as compared to an inventive toner made according to the present embodiments.

As discussed above, there is a constant desire to improve the overall charging performance of toner compositions. In the present embodiments, a fluorinated surfactant is incorporated into and distributed throughout the toner core to improve toner charging. The incorporation of such additives into toners, in particular, emulsion aggregation (EA) toners, have provided improved charging without any significant adverse impact on the other properties of the toner. In a specific embodiment, the fluorinated surfactant was added during the emulsion polymerization of the styrene-acrylate latex step for making an EA toner. This latex was then used as 28 percent, or from 15 to about 50, or from 20 to about 40, or from 25 to about 30 percent, of the total latex for the toner making step. In another embodiment, the fluorinated surfactant was added during the solvent flashing stage or phase inversion emulsification (PIE) by a process which includes melt mixing a mixture at an elevated temperature containing at least one amorphous resin, an organic solvent, a fluorosurfactant, and a neutralizing agent to form a latex emulsion. The resins may be pre-blended prior to melt mixing.

Surfactants

The present embodiments provide a toner composition comprising at least a resin binder, colorant, wax and toner additive. The additive comprises a fluorinated surfactant which is a surface active agent commonly described as a molecule consisting of a hydrophilic moiety and a hydrophobic moiety containing a fluorine substituted hydrocarbon. Fluorosurfactants can be linear or branched alkyl, alkenyl or alkylaryl fluorohydrocarbons with full or partial fluorination. The hydrophilic moiety can be sulfate, phosphate, sulfonate, amine, amine salts, quaternary ammonium, or carboxylate. There can be a bridging moiety between the hydrophilic and hydrophobic moieties, such as an amido alkylene group. An example of a subset of ionic fluorosurfactants useful in the present toner composition are perfluorinated compounds which can be represented by the formula:

$$CF_3—(CF_2)_x—(CH_2)_y—Z$$

wherein Z is a water solubilizing group of either organic or inorganic character, x is an integer which is generally from 2 to 17, particularly from 7 to 11, and y is an integer from 0 to 4, and the said compounds may be cationic, anionic, amphoteric or zwitterionic, depending upon the nature of the grouping or groupings encompassed by Z. The Z groups may be or may comprise sulfate, sulfonate, carboxylate, amine salt, quaternary ammonium, phosphate, phosphonate, and combinations thereof. The perfluorinated compounds are known in the art.

Suitable anionic fluorosurfactants can have anionic moieties which include carboxylates, sulfates, sulfonates, phosphonates and phosphates or any combination thereof. Counterions therefore can include sodium, $NH_4$, magnesium, potassium, tri-ethanolamine, diethanolamine, and similar moieties. Suitable cationic fluorosurfactants can have cationic moieties which include quaternary ammonium compounds where the counterions can be chloride or any other halide, methosulfate, ethosulfate, phosphate, acetate, and other similar moieties. Also, suitable cationic fluorosurfactants can have cationic moieties which include primary, secondary and tertiary amine salts of acids such as hydrochloric, lactic, phosphoric, sulfuric and other similar acids. Amphoteric fluorosurfactants contain both a carboxylate and an amine group. Zwitterionic fluorosurfactants contain an anionic moiety such as a carboxylate, sulfate, sulfonate, and phosphate group or other similar groups as well as a cation moiety such as a quaternary ammonium or amine salt. It should be noted that the terms "amphoteric" and "zwitterionic" have been used interchangeably by chemical supply companies and that the classification of fluorosurfactants herein may differ from that given by supplying companies.

Possible cationic fluorosurfactants for use in the toner composite include fluorinated alkyl quaternary ammonium salts having a variety of anionic counter ions, including iodide, chloride, methosulfate, phosphate, and nitrate salts, preferably an iodide; and those fluorosurfactants conforming to the formula $R_fCH_2CH_2SCH_2CH_2N^+(CH_3)_3[CH_3SO_4]^-$ wherein $R_f$=$F(CF_2CF_2)_{3-8}$, such as Zonyl FSC® supplied by DuPont. Preferred fluorinated alkyl quaternary ammonium iodides are supplied under the tradename Fluorad FC-135® supplied by 3M. Possible cationic fluorosurfactants from Chemguard are S-106A cationic alkyl ammonium chloride fluorosurfactant and S-208M cationic blend alkyl ammonium chloride fluorosurfactant blend.

Anionic fluorosurfactants for use in the toner composites are mono-, and bis-perfluoroalkyl phosphates, such as Zonyl FSP® supplied by DuPont and conforming to the general formulae $(R_fCH_2CH_2O)P(O)(ONH_4)_2(R_fCH_2CH_2O)_2P(O)(ONH_4)$ wherein $R_f$=$F(CF_2CF_2)_{3-8}$; mono- and bis-fluoroalkyl phosphates, having a variety of cationic counterions such as ammonium, sodium, potassium, triethanolamine and diethanolamine salts, preferably ammonium salts, complexed with non-fluorinated quats, preferably aliphatic quaternary methosulfates, such as Zonyl FSJ® supplied by DuPont; perfluoroalkyl sulfonic acid having a variety of cationic counterions such as ammonium, sodium, potassium, triethanolamine and diethanolamine salts, preferably ammonium salts, such as Zonyl TBS® supplied by DuPont and conforming to the formula $R_fCH_2CH_2SO_3X$ wherein $R_f$=$F(CF_2CF_2)_{3-8}$ and X=H and $NH_4$; telomer phosphates, having a variety of cationic counterions such as ammonium, sodium, potassium, triethanolamine and diethanolamine salts, preferably diethanolamine salts, such as Zonyl RP® supplied by DuPont; amine perfluoroalkyl sulfonates, such as Fluorad FC-99® supplied by 3M; ammonium perfluoroalkyl sulfonates, such as Fluorad FC-93®, Fluorad FC-120® and L-12402®, supplied by 3M; potassium perfluoroalkyl sulfonates, such as Fluorad FC-95® and Fluorad FC-98® supplied by 3M; potassium fluorinated alkyl carboxylates, such as Fluorad FC-129® and supplied by 3M; ammonium perfluoroalkyl carboxylates, such as Fluorad FC-143® supplied by 3M; and those fluorosurfactants conforming to the general formula $R_fCH_2CH_2SCH_2CH_2CO_2Li$ wherein $R_f$=$F(CF_2CF_2)_{3-8}$, such as Zonyl FSA® supplied by DuPont. Chemguard supplies S-103A anionic alkyl sodium sulfonate fluorosurfactant, S-760P anionic ammonia neutralized phosphate ester, S-761P anionic diethanolamine neutralized phosphate ester, and S-764P anionic ammonia neutralized phosphate ester.

Possible amphoteric fluorosurfactants for use in the toner composites are fluorinated alkyl amphoterics such as Fluorad FC-100® supplied by 3M; and fluorosurfactant L-12231 supplied by 3M. As well there is Chemguard S-111 amphoteric alkyl amine oxide fluorosurfactant and Chemguard S-500 amphoteric alkyl betaine fluorosurfactant.

Possible zwitterionic fluorosurfactants for use in the present by weight are those fluorosurfactants conforming to the formula $R_fCH_2CH(OCOCH_3)CH_2N'(CH_3)_2CH_2CO_2$ wherein $R_f$=$F(CF_2CF_2)_{3-8}$ such as Zonyl FSK® supplied by DuPont. Nonionic fluorosurfactants from Chemguard include S-554, S-550 and S-559, all polyalkyl ether type fluorosurfactants.

Further specific examples of fluorosurfactants include perfluoroalkyl sulfonates (e.g., perfluorooctane sulfonate, $C_8F_{15}SO_3$, PFOS), perfluoroalkyl carboxylic acids (e.g., perfluorooctanoic acid, $C_7F_{15}COOH$, PFOA), perfluoroalkyl acids (PFAAs) such as perfluoroalkyl sulfonic acid (PFSA; $F(CF_2)_nSO_3H$), perfluoroalkyl carboxylic acid (PFCA; $F(CF_2)_nCO_2H$), perfluoroalkyl phosphonic acid (PFPA $F(CF_2)nP(=O)(OH)_2$) and perfluoroalkyl phosphinic acid (PFPIA F(CF2)nP(=O)(OH), ionic fluorosurfactant such as fluorinated alkyl quaternary ammonium iodides; mono- and bis-perfluoroalkyl phosphates, mono- and bis-fluoroalkyl phosphate, complexed with aliphatic quaternary methosulfates; salts of perfluoroalkyl sulfonic acid; telomer phosphate diethanolamine salts; amine perfluoroalkyl sulfonates; ammonium perfluoroalkyl sulfonates; potassium perfluoroalkyl sulfonates; fluorinated alkyl carboxylates; and fluorinated alkyl sulfonates.

The fluorinated surfactants have short chains having no more than 18 carbons or from about 2 to about 10 carbons. In one embodiment, the fluorinated surfactant is a fluorosurfactant of the phosphate ester type. In a specific embodiment, the fluorinated surfactant is S-764P (available from Chemguard (Mansfield, Tex.)). Chemguard S-764P is a short-chain perfluoro-based VOC-free anionic fluorosurfactant of the phosphate ester type.

Any suitable surfactants may be used for the preparation of the latex and wax dispersions according to the present disclosure. Depending on the emulsion system, any desired anionic surfactant may be contemplated.

In the present embodiments, at least a fluorinated surfactant is used in the toner. Such surfactants may be employed in any desired or effective amount, for example, at least about 0.01% by weight of total monomers used to prepare the latex polymer, at least about 0.1% by weight of total monomers used to prepare the latex polymer; and no more than about 5% by weight of total monomers used to prepare the latex polymer, no more than about 2% by weight of total monomers used to prepare the latex polymer, although the amount can be outside of those ranges.

The fluorinated surfactants provide lower surface tensions over the current surfactants, such as DowFax and Tayca, that are being used. Although the fluorinated surfactant is more expensive than the current hydrocarbon surfactants being used, the amount of fluorinated surfactant needed is much less and results in a net cost savings in the toner. Results show that latex particle size is proportional to the amount of fluorosurfactant added in the range of from about 0.001 to about 2.0 percent by weight of the toner, or from about 0.005 to about 1.0 percent by weight of the toner, or from about 0.01 to about 0.5 percent by weight of the toner. However, experimental data has demonstrated that only about 0.01 to about 0.05 percent by weight of the toner is required in the formulation to provide the improved charging. In embodiments, the amount of fluorine on the toner surface is from about $5\times10^{-7}$ atom % to about 0.8 atom %, or from about $5\times10^{-6}$ atom % to about 0.6 atom %, or from about $5\times10^{-5}$ atom % to about 0.5 atom. In embodiments, the resulting toner has a particle size of from about 3 to about 10 microns, or of from about 4 to about 8 microns, or of from about 5 to about 7 microns.

Benefits of the present embodiments include a slight reduction in toner cost without sacrificing quality, as compared to the hydrocarbon-based surfactants currently being used. The fluorosurfactants provide surface tensions as low as 15 dynes/cm, or from about 17 to about 30 dynes/cm, in water at very low concentrations (e.g., concentration of 0.01% to 0.001%). Such surfactants also have excellent dynamic surface tension properties, allowing for rapid attainment of low-equilibrium surface tensions, as well as, excellent thermostability at concentrations as low as 50-1,000 parts per million (0.005-0.100%). Due to their low surface tension these surfactants are also considered to be very low foaming as compared to our standard anionic surfactants like Dowfax 2A1 and Taycapower.

Cost comparisons between the fluorosurfactants and the hydrocarbon surfactants demonstrate cost-effectiveness of the fluorosurfactants due to the fact that these surfactants require much less than conventional surfactants in order to work as intended. For example, for every 0.5% of hydrocarbon-based surfactants used, only about 0.01% of the fluorosurfactant is needed to obtain the same results; the typical amount of fluorosurfactant used would be about 10 to 100 times less. This translates to a savings of $0.04 per gallon, which is very cost effective.

The fluorinated surfactants of the present embodiments also include a number of other attributes. For example, these surfactants are VOC-free and chloride-free and thus environmentally friendly. As mentioned above, these surfactants are also low foaming. The surfactants further impart excellent anti-blocking characteristics, provide excellent interaction with wetting contaminated or difficult to coat surfaces, and provide oil repellency to water-based stains. In embodiments, these fluorinated surfactants are composed of short chain C-6 perfluoro telomere.

Latex Resin

In embodiments, a developer is disclosed including a resin coated carrier and a toner, where the toner may be an emulsion aggregation toner, containing, but not limited to, a latex resin, a wax and a polymer shell.

In embodiments, the latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vice versa. Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof. In case a mixture of monomers is used, typically the latex polymer will be a copolymer.

In some embodiments, the first monomer composition and the second monomer composition may independently of each other comprise two or three or more different monomers. (side note—sounds very similar to my entry above) The latex polymer therefore can comprise a copolymer. Illustrative examples of such a latex copolymer includes poly(styrene-n-butyl acrylate-β-CEA), poly(styrene-alkyl acrylate), poly (styrene-1,3-diene), poly(styrene-alkyl methacrylate), poly (alkyl methacrylate-alkyl acrylate), poly(alkyl methacrylate-aryl acrylate), poly(aryl methacrylate-alkyl acrylate), poly (alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

In embodiments, the resins may be a polyester resin, such as, an amorphous resin, a crystalline resin, and/or a combination thereof, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly (hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly (5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), polypropylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin. Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl) propane, and polyoxypropylene (6)-2,2-bis(4-hydroxyphenyl) propane. These compounds may be used singly or as a combination of two or more thereof.

Examples of additional diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Furthermore, in embodiments, a crystalline polyester resin may be contained in the binding resin. The crystalline polyester resin may be synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

As the acid-derived component, an aliphatic dicarboxylic acid may be utilized, such as a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as lower alkyl esters and acid anhydrides thereof. Among these, acids having 6 to 10 carbon atoms may be desirable for obtaining suitable crystal melting point and charging properties. In order to improve the crystallinity, the straight chain carboxylic acid may be present in an amount of about 95% by mole or more of the acid component and, in embodiments, more than about 98% by mole of the acid component. Other acids are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof, as well as combinations thereof, and the like. As the acid-derived component, a component such as a dicarboxylic acid-derived component having a sulfonic acid group may also be utilized. The dicarboxylic acid having a sulfonic acid group may be effective for obtaining excellent dispersion of a coloring agent such as a pigment. Furthermore, when a whole resin is emulsified or suspended in water to prepare a toner mother particle, a sulfonic acid group, may enable the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like may be desirable in view of the cost. The content of the dicarboxylic acid having a sulfonic acid group may be from about 0.1% by mole to about 2% by mole, in embodiments from about 0.2% by mole to about 1% by mole. When the content is more than about 2% by mole, the charging properties may be deteriorated. Here, "component mol %" or "component mole %" indicates the percentage when the total amount of each of the components (acid-derived component and alcohol-derived component) in the polyester resin is assumed to be 1 unit (mole).

As the alcohol component, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having from about 6 to about 10 carbon atoms may be used to obtain desirable crystal melting points and charging properties. In order to raise crystallinity, it may be useful to use the straight chain dialcohols in an amount of about 95% by mole or more, in embodiments about 98% by mole or more.

Examples of other dihydric dialcohols which may be utilized include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol, neopentyl glycol, combinations thereof, and the like.

For adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane, pentaerythritol, combinations thereof, and the like.

The crystalline polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, may be used in excess.

Initiators

Any suitable initiator or mixture of initiators may be selected in the latex process and the toner process for the styrene-based toners. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl-1,4-diphenyl-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments for styrene-based toners, the chain transfer agent has a carbon-sulfur covalent bond. The carbon-sulfur covalent bond has an absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610 ™; Northern Pigments magnetites, NP604™ and NP608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In embodiments, toner compositions may be prepared by emulsion-aggregation processes, such as, a process that includes aggregating a mixture of an optional wax and any other desired or required additives, and emulsions including the resins described above, optionally with surfactants, as described above, and then coalescing the aggregate mixture. A mixture may be prepared by adding an optional wax or other materials, which optionally also may be in a dispersion(s) including a surfactant, to the emulsion, which may be a mixture of two or more emulsions containing the resin. The pH of the resulting mixture may be adjusted by an acid (i.e., a pH adjustor) such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer or a Gaulin 15MR homogenizer.

Following preparation of the above mixture, an aggregating agent may be added to the mixture. Suitable aggregating agents include, for example, aqueous solutions of a divalent cation or a multivalent cation material. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature ($T_g$) of the resin.

The aggregating agent may be added to the mixture to form a toner in an amount of, for example, from about 0.1 parts per hundred (pph) to about 1 pph, in embodiments, from about 0.25 pph to about 0.75 pph.

The gloss of a toner may be influenced by the amount of retained metal ion, such as, $Al^{3+}$, in the particle. The amount of retained metal ion may be adjusted further by the addition of ethylene diamine tetraacetic acid (EDTA). In embodiments, the amount of retained metal ion, for example, $Al^{3+}$, in toner particles of the present disclosure may be from about 0.1 pph to about 1 pph, in embodiments, from about 0.25 pph to about 0.8 pph.

The disclosure also provides a melt mixing process to produce low cost and safe cross-linked thermoplastic binder resins for toner compositions which have, for example, low fix temperature and/or high offset temperature, and which may show minimized or substantially no vinyl offset. In the process, unsaturated base polyester resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By, "highly cross-linked," is meant that the polymer involved is substantially cross-linked, that is, equal to or above the gel point. As used herein, "gel point," means the point where the polymer is no longer soluble in solution (see, e.g., U.S. Pat. No. 4,457,998, herein incorporated by reference in entirety).

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the $T_g$ of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at that temperature for a time from about 0.5 hr to about 6 hr, in embodiments, from about 1 hr to about 5 hr, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 6.0 μm, about 6.0 to about 6.5 μm, about 6.5 to about 7.0 μm, about 7.0 to about 7.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 90° C., in embodiments, from about 45° C. to about 80° C., which may be below the $T_g$ of the resin.

Following aggregation to the desired particle size, with the optional formation of a shell as described above, the particles then may be coalesced to the desired final shape, the coalescence being achieved by, for example, heating the mixture to a temperature of from about 55° C. to about 100° C., in embodiments from about 65° C. to about 75° C., which may be below the melting point of a crystalline resin to prevent plasticization. Higher or lower temperatures may be used, it being understood that the temperature is a function of the resins used.

Coalescence may proceed over a period of from about 0.1 to about 9 hr, in embodiments, from about 0.5 to about 4 hr.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

Toners may possess favorable charging characteristics when exposed to extreme RH conditions. The low humidity zone (C zone) may be about 12° C./15% RH, while the high humidity zone (A zone) may be about 28° C./85% RH. Toners of the disclosure may possess a parent toner charge per mass ratio (Q/M) of from about −5 μC/g to about −80 μC/g, in embodiments, from about −10 μC/g to about −70 μC/g, and a final toner charging after surface additive blending of from −15 μC/g to about −60 μC/g, in embodiments, from about −20 μC/g to about −55 μC/g.

In particular embodiments, the toner comprises a styrene-based (e.g., styrene/n-butyl acrylate copolymer resin) resin. Toners of such embodiments are made in the following manner: the emulsion aggregation toner preparation process comprises forming a toner particle by mixing the styrene-based polymer resin with a wax (such as in a dispersion or emulsion), and a colorant dispersion, to which is added a coagulant of for example, a poly metal halide such as polyaluminum chloride while blending at high speeds such as with a polytron. The resulting mixture having a pH of about 2 to about 3 is aggregated by heating to a temperature below the resin Tg to provide toner size aggregates. Additional resin latex (which may be the same as or different from the styrene-based polymer resin, as described above) is added to the formed aggregates providing a shell over the formed aggregates. The pH of the mixture is then changed by the addition of a base such as a sodium hydroxide solution until a pH of about 7 is achieved. When the mixture reaches a pH of about 7, the carboxylic acid becomes ionized to provide additional negative charge on the aggregates thereby providing stability and preventing the particles from further growth or an increase in the size distribution when heated above the Tg of the latex resin. The temperature of the mixture is then raised to about 95° C. After about 30 minutes, the pH of the mixture is reduced to a value sufficient to coalesce or fuse the aggregates to provide a composite particle upon further heating such as about 4.5. The fused particles can be measured for shape factor or circularity, such as with a Sysmex FPIA 2100 analyzer, until the desired shape is achieved.

In other embodiments, the toner comprises a crystalline or amorphous polyester resin. Toners of such embodiments are made in the following manner: emulsion aggregation by (i) generating or providing a latex emulsion containing an amorphous polyester, a crystalline polyester of a mixture of crystalline polyesters and amorphous polyesters, and water and surfactants, and generating or providing a colorant dispersion containing colorant, water, and an ionic surfactant, or a nonionic surfactant; (ii) blending the latex emulsions (comprising the amorphous polyester, crystalline polyester or mixture of both) with the colorant dispersion and optional additives, such as a wax; (iii) adding to the resulting blend a coagulant comprising a polymetal ion coagulant, a metal ion coagulant, a polymetal halide coagulant, a metal halide coagulant, or a mixtures thereof; (iv) aggregating by heating the resulting mixture below or about equal to the glass transition temperature (Tg) of the amorphous polyester latex resin to form a core; (v) optionally adding a further latex comprised of the amorphous polyester resin suspended in an aqueous phase resulting in a shell; (vi) introducing a sodium hydroxide solution to increase the pH of the mixture to about 4, followed by the addition of a sequestering agent to partially remove coagulant metal from the aggregated toner in a controlled manner; (vii) heating the resulting mixture of (vi) about equal to or about above the Tg of the latex polyester resins mixture at a pH of from about 5 to about 6; (viii) retaining the heating until the fusion or coalescence of resins and colorant are initiated; (ix) changing the pH of the above (viii) mixture to arrive at a pH of from about 6 to about 7.5 thereby accelerating the fusion or the coalescence, and resulting in toner particles comprised of the amorphous polyester resins and crystalline polyesters, colorant, and optional additives; and (x) optionally, isolating the toner.

In the above method, first step of generating an emulsion comprises dissolving the polyester resin or mixture of polyester resins in an organic solvent, neutralizing the acid groups with an alkali base. The acid groups of the polyester resin may be neutralized with an alkali base. Suitable alkali bases include, for example, sodium hydroxide, potassium hydroxide, lithium hydroxide, ammonium hydroxide, sodium bicarbonate, sodium carbonate, lithium carbonate, lithium bicarbonate, potassium bicarbonate and potassium carbonate. The alkali base is used in an amount to fully neutralize the acid. Complete neutralization is accomplished by measuring the pH of the emulsion, for example, pH of about 7. In embodiments, the at least one high acid number polyester resin can thus be emulsified in water without surfactant, for example by utilizing an alkali base such as sodium hydroxide. The carboxylic acid groups of the polyester are ionized to the sodium (or other metal ion) salt and self stabilize when prepared by a solvent flash process, as described in U.S. Pat. No. 7,858,285, which is hereby incorporated by reference in its entirety.

Neutralizing Agent

In embodiments, the resin may be mixed with a weak base or neutralizing agent. In embodiments, the neutralizing agent may be used to neutralize acid groups in the resins, so a neutralizing agent herein may also be referred to as a "basic neutralization agent." Any suitable basic neutralization reagent may be used in accordance with the present disclosure. In embodiments, suitable basic neutralization agents may include both inorganic basic agents and organic basic agents. Suitable basic agents may include ammonium hydroxide, potassium hydroxide, sodium hydroxide, sodium carbonate, sodium bicarbonate, lithium hydroxide, potassium carbonate, combinations thereof, and the like. Suitable basic agents may also include monocyclic compounds and polycyclic compounds having at least one nitrogen atom, such as, for example, secondary amines, which include aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines, and combinations thereof. In embodiments, the monocyclic and polycyclic compounds may be unsubstituted or substituted at any carbon position on the ring.

In embodiments, an emulsion formed in accordance with the present disclosure may also include a small quantity of water, in embodiments, de-ionized water (DIW), in amounts of from about 30% to about 95%, in embodiments, of from about 30% to about 60%, at temperatures that melt or soften the resin, of from about 20° C. to about 120° C., in embodiments from about 30° C. to about 100° C.

The basic agent may be utilized in an amount of from about 0.001% by weight to 50% by weight of the resin, in embodiments from about 0.01% by weight to about 25% by weight of the resin, in embodiments from about 0.1% by weight to 5% by weight of the resin. In embodiments, the neutralizing agent may be added in the form of an aqueous solution. In other embodiments, the neutralizing agent may be added in the form of a solid.

Utilizing the above basic neutralization agent in combination with a resin possessing acid groups, a neutralization ratio of from about 25% to about 500% may be achieved, in embodiments from about 50% to about 300%. In embodiments, the neutralization ratio may be calculated as the molar ratio of basic groups provided with the basic neutralizing agent to the acid groups present in the resin multiplied by 100%.

As noted above, the basic neutralization agent may be added to a resin possessing acid groups. The addition of the basic neutralization agent may thus raise the pH of an emulsion including a resin possessing acid groups from about 5 to about 12, in embodiments, from about 6 to about 11. The neutralization of the acid groups may, in embodiments, enhance formation of the emulsion. Examples of neutralizing agents are provided in U.S. Pat. No. 8,338,071, which is incorporated by reference in its entirety.

Shell Resin

In embodiments, a shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described herein. The aggregated particles described above may be combined with said emulsion so that the resin forms a shell over the formed aggregates. In embodiments, an amorphous polyester may be utilized to form a shell over the aggregates to form toner particles having a core-shell configuration.

Toner particles can have a size of diameter of from about 4 to about 8 μm, in embodiments, from about 5 to about 7 μm, the optimal shell component may be about 26 to about 30% by weight of the toner particles.

Alternatively, a thicker shell may be desirable to provide desirable charging characteristics due to the higher surface area of the toner particle. Thus, the shell resin may be present in an amount from about 30% to about 40% by weight of the toner particles, in embodiments, from about 32% to about 38% by weight of the toner particles, in embodiments, from about 34% to about 36% by weight of the toner particles.

In embodiments, a photoinitiator may be included in the shell. Thus, the photoinitiator may be in the core, the shell, or both. The photoinitiator may be present in an amount of from about 1% to about 5% by weight of the toner particles, in embodiments, from about 2% to about 4% by weight of the toner particles.

Emulsions may have a solids loading of from about 5% solids by weight to about 20% solids by weight, in embodiments, from about 12% solids by weight to about 17% solids by weight.

Once the desired final size of the toner particles is achieved, the pH of the mixture may be adjusted with a base (i.e., a pH adjustor) to a value of from about 6 to about 10, and in embodiments from about 6.2 to about 7. The adjustment of the pH may be utilized to freeze, that is to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, EDTA may be added to help adjust the pH to the desired values noted above. The base may be added in amounts from about 2 to about 25% by weight of the mixture, in embodiments, from about 4 to about 10% by weight of the mixture. In embodiments, the shell has a higher $T_g$ than the aggregated toner particles.

Carriers

Various suitable solid core or particle materials can be utilized for the carriers and developers of the present disclosure. Characteristic particle properties include those that, in embodiments, will enable the toner particles to acquire a positive charge or a negative charge, and carrier cores that provide desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier particles or cores that can be utilized include iron and/or steel, such as, atomized iron or steel powders available from Hoeganaes Corporation or Pomaton S.p.A (Italy); ferrites, such as, Cu/Zn-ferrite containing, for example, about 11% copper oxide, about 19% zinc oxide, and about 70% iron oxide, including those commercially available from D.M. Steward Corporation or Powdertech Corporation, Ni/Zn-ferrite available from Powdertech Corporation, Sr (strontium)-ferrite, containing, for example, about 14% strontium oxide and about 86% iron oxide, commercially available from Powdertech Corporation, and Ba-ferrite; magnetites, including those commercially available from, for example, Hoeganaes Corporation (Sweden); nickel; combinations thereof, and the like. In embodiments, the polymer particles obtained can be used to coat carrier cores of any known type by various known methods, and which carriers then are incorporated with a known toner to form a developer for electrophotographic printing. Other suitable carrier cores are illustrated in, for example, U.S. Pat. Nos. 4,937,166, 4,935,326 and 7,014,971, the disclosure of each of which hereby is incorporated by reference in entirety, and may include granular zircon, granular silicon, glass, silicon dioxide, combinations thereof, and the like. In embodiments, suitable carrier cores may have an average particle size of, for example, from about 20 μm to about 400 μm in diameter, in embodiments, from about 40 μm to about 200 μm in diameter.

In embodiments, a ferrite may be utilized as the core, including a metal, such as, iron and at least one additional metal, such as, copper, zinc, nickel, manganese, magnesium, calcium, lithium, strontium, zirconium, titanium, tantalum, bismuth, sodium, potassium, rubidium, cesium, strontium, barium, yttrium, lanthanum, hafnium, vanadium, niobium, aluminum, gallium, silicon, germamium, antimony, combinations thereof and the like.

In some embodiments, the carrier coating may include a conductive component. Suitable conductive components include, for example, carbon black.

There may be added to the carrier a number of additives, for example, charge enhancing additives, including particulate amine resins, such as, melamine, and certain fluoropolymer powders, such as alkyl-amino acrylates and methacrylates, polyamides, and fluorinated polymers, such as polyvinylidine fluoride and poly(tetrafluoroethylene) and fluoroalkyl methacrylates, such as 2,2,2-trifluoroethyl methacrylate. Other charge enhancing additives which may be utilized include quaternary ammonium salts, including distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, combinations thereof, and the like, and other effective known charge agents or additives. The charge additive components may be selected in various effective amounts, such as from about 0.5 wt % to about 20 wt %, from about 1 wt % to about 3 wt %, based, for example, on the sum of the weights of polymer/copolymer, conductive component, and other charge additive components. The addition of conductive components can act to further increase the negative triboelectric charge imparted to the carrier, and therefore, further increase the negative triboelectric charge imparted to the toner in, for example, an electrophotographic development subsystem. The components may be included by roll mixing, tumbling, milling, shaking, electrostatic powder cloud spraying, fluidized bed, electrostatic disc processing, and an electrostatic curtain, as described, for example, in U.S. Pat. No. 6,042,981, the disclosure of which hereby is incorporated by reference in entirety, and wherein the carrier coating is fused to the carrier core in either a rotary kiln or by passing through a heated extruder apparatus.

Conductivity can be important for semiconductive magnetic brush development to enable good development of solid areas which otherwise may be weakly developed. Addition of a polymeric coating of the present disclosure, optionally with a conductive component such as carbon black, can result in carriers with decreased developer triboelectric response with change in relative humidity of from about 20% to about 90%, in embodiments, from about 40% to about 80%, that the charge is more consistent when the relative humidity is changed. Thus, there is less decrease in charge at high relative humidity reducing background toner on the prints, and less increase in charge and subsequently less loss of development at low relative humidity, resulting in such improved image quality performance due to improved optical density.

As noted above, in embodiments the polymeric coating may be dried, after which time it may be applied to the core carrier as a dry powder. Powder coating processes differ from conventional solution coating processes. Solution coating requires a coating polymer whose composition and molecular weight properties enable the resin to be soluble in a solvent in the coating process. That requires relatively low $M_w$ components as compared to powder coating. The powder coating process does not require solvent solubility, but does require the resin coated as a particulate with a particle size of from about 10 nm to about 2 μm, in embodiments, from about 30 nm to about 1 μm, in embodiments, from about 50 nm to about 500 nm.

Examples of processes which may be utilized to apply the powder coating include, for example, combining the carrier core material and resin coating by cascade roll mixing, tumbling, milling, shaking, electrostatic powder cloud spraying, fluidized bed, electrostatic disc processing, electrostatic curtains, combinations thereof and the like. When resin coated carrier particles are prepared by a powder coating process, the majority of the coating materials may be fused to the carrier surface, thereby reducing the number of toner impaction sites on the carrier. Fusing of the polymeric coating may occur by mechanical impaction, electrostatic attraction, combinations thereof and the like.

Following application of the resin to the core, heating may be initiated to permit flow of the coating material over the surface of the carrier core. The concentration of the coating material, in embodiments, powder particles, and the parameters of the heating may be selected to enable the formation of a continuous film of the coating polymers on the surface of the carrier core, or permit only selected areas of the carrier core to be coated. In embodiments, the carrier with the polymeric powder coating may be heated to a temperature of from about 170° C. to about 280° C., in embodiments from about 190° C. to about 240° C., for a period of time of, for example, from about 10 min to about 180 min, in embodiments, from about 15 min to about 60 min, to enable the polymer coating to melt and to fuse to the carrier core particles. Following incorporation of the powder on the surface of the carrier, heating may be initiated to permit flow of the coating material over the surface of the carrier core. In embodiments, the powder may be fused to the carrier core in either a rotary kiln or by passing through a heated extruder apparatus, see, for example, U.S. Pat. No. 6,355,391, the disclosure of which hereby is incorporated by reference in entirety.

In embodiments, the coating coverage encompasses from about 10% to about 100% of the carrier core. When selected areas of the metal carrier core remain uncoated or exposed, the carrier particles may possess electrically conductive properties when the core material is a metal.

The coated carrier particles may then be cooled, in embodiments to room temperature, and recovered for use in forming developer.

In embodiments, carriers of the present disclosure may include a core, in embodiments, a ferrite core, having a size of from about 20 μm to about 100 μm, in embodiments, from about 30 μm to about 75 μm, coated with from about 0.5% to about 10% by weight, in embodiments, from about 0.7% to about 5% by weight, of the polymer coating of the present disclosure, optionally including carbon black.

Thus, with the carrier compositions and processes of the present disclosure, there can be formulated developers with selected high triboelectric charging characteristics and/or conductivity values utilizing a number of different combinations.

Developers

The toner particles thus formed may be formulated into a developer composition. The toner particles may be mixed with carrier particles to achieve a two component developer composition. The toner concentration in the developer may be from about 1% to about 25% by weight of the total weight of the developer, in embodiments, from about 2% to about 15% by weight of the total weight of the developer.

Imaging

The toners can be utilized for electrophotographic processes, including those disclosed in U.S. Pat. No. 4,295,990, the disclosure of which is hereby incorporated by reference in entirety. In embodiments, any known type of image development system may be used in an image developing device, including, for example, magnetic brush development, hybrid scavengeless development (HSD) and the like. Those and similar development systems are within the purview of those skilled in the art.

It is envisioned that the toners of the present disclosure may be used in any suitable procedure for forming an image with a toner, including in applications other than xerographic applications.

Utilizing the toners of the present disclosure, images may be formed on substrates, including flexible substrates, having a toner pile height of from about 1 μm to about 6 μm, in embodiments, from about 2 μm to about 4.5 μm, in embodiments, from about 2.5 to about 4.2 μm.

In embodiments, the toner of the present disclosure may be used for a xerographic print protective composition that provides overprint coating properties including, but not limited to, thermal and light stability and smear resistance, particularly in commercial print applications. More specifically, such overprint coating as envisioned has the ability to permit overwriting, reduce or prevent thermal cracking, improve fusing, reduce or prevent document offset, improve print performance and protect an image from sun, heat and the like. In embodiments, the overprint compositions may be used to improve the overall appearance of xerographic prints due to the ability of the compositions to fill in the roughness of xerographic substrates and toners, thereby forming a level film and enhancing glossiness.

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

The examples set forth herein below are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Example 1

In the working example, has been determined that an optimal range of the surfactant is 0.01 to 0.05 percent by weight of the toner. Even with the highest loading needed; the savings is 50% at this loading as compared to the loading for conventional surfactants. The loading of 0.2% is redundant and actually causes particle size issues as seen in Table 1 below. As fluorinated surfactant loading goes down, so does particle size.

TABLE 1

| Latex Type | Sample 1 | Sample 2 | Sample 3 |
|---|---|---|---|
| Styrene (%) | 79.3 | 79.3 | 79.3 |
| n-Butyl Acrylate (%) | 20.7 | 20.7 | 20.7 |
| S-764P Fluorosurfactant | 0.75 | 0.20 | 1.00 |
| Fluorosurfactant partition | 15/85 | 15/85 | 15/85 |
| Seed (%) | 1.0 | 1.0 | 1.0 |
| Particle Size $D_{50}$ (nm) | 394.0 | 295.0 | 592.0 |

The fluorinated surfactant was added during the emulsion polymerization of the styrene-acrylate latex step. This latex was then used as 28% of the total latex for the toner making step. The toner was subsequently machine tested.

Example 2

Preparation of Emulsion Polymerization of Styrene-Based Resin with 0.75% Fluorinated Surfactant

Latex Sample 1

A latex emulsion comprised of polymer particles generated from the emulsion polymerization of styrene, n-butyl acrylate, beta-Carboxyethyl Acrylate (beta-CEA) and S-764P fluorosurfactant was prepared as follows.

A surfactant solution of 1.4 grams S-764P (anionic fluorosurfactant from Chemguard) and 237.4 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 450 rpm. The reactor was then heated up to 80° C. at a controlled rate, and held there. Separately, 4.1 grams of ammonium persulfate initiator was dissolved in 37.9 grams of de-ionized water.

Separately, the monomer emulsion was prepared in the following manner. 215 g of styrene, 56 g of butyl acrylate, 8.1 g of beta-CEA, 1.8 g of 1-dodecanethiol, 0.95 g of 1,10-decanediol diacrylate (ADOD) were added to a premix of 7.9 g of S-764P in 127.2 g of deionized water were mixed to form an emulsion. 1% of the above emulsion (4.2 g) was then slowly dropped into the reactor containing the aqueous surfactant phase at 80° C. to form the "seeds" while being purged with nitrogen. The initiator solution was then slowly charged into the reactor. The monomer emulsion was split into two aliquots, 204.3 g of the monomer emulsion was initially feed into the reactor at 1.65 g/min. The second aliquot of 206.6 g monomer emulsion was mixed with 2.3 g of DDT and added to the reactor at 2.30 g/min. Once all the monomer emulsion was charged into the main reactor, the temperature was held at 80° C. for an additional 2 hours to complete the reaction. Full cooling was then applied and the reactor temperature was reduced to 25° C. The product was collected into a holding tank and sieved with a 25 μm screen.

The particle size was then measured by Nanotrac® U2275E particle size analyzer to have a $D_{50}$ of 394 nm. This latex was then used to make an EA toner.

Example 3

Preparation of Emulsion Polymerization of Styrene-Based Resin with 0.75% Fluorinated Surfactant

Latex Sample 2

Sample 2 was also synthesized in the same manner as Sample 1 but with a total of 2.46 g of S-764P partitioned 0.4 g to 2.1 g to give a total amount of 1.0% S-764P relative to monomers.

Example 4

Preparation of Emulsion Polymerization of Styrene-Based Resin with 0.75% Fluorinated Surfactant

Latex Sample 3

Sample 3 was synthesized in the same manner as Sample 1 but with a total of 12.32 g of S-764P partitioned 1.8 g to 10.5 g to give a total amount of 1.0% S-764P relative to monomers.

Example 5

Toner Example 1

Preparation of Black Styrene-Based Toner with Fluorinated Surfactant

A black EA styrene-acrylate toner was prepared at the 2 L Bench scale (155 g dry theoretical toner).

In a 2 L glass reactor, 98 grams of a latex emulsion comprised of polymer particles generated from the emulsion polymerization of styrene, butyl acrylate and beta carboxy ethyl acrylate (β-CEA) (lot. SDC-EP07, 41% solids), 132 grams of a latex emulsion comprised of polymer particles generated from the emulsion polymerization of styrene, butyl acrylate, beta carboxy ethyl acrylate (β-CEA) and Chemguard S-764P (Fluorinated surfactant, 22% active, 33% solids), 58 grams of aqueous paraffin wax dispersion (lot. Paraffin N-539, 30% solids), 58 grams of Black pigment dispersion (lot. Nipex-35, 17.5% solids), and 10 grams of Cyan pigment dispersion (lot Sun PB15-3, 16% solids) are added to about 470 grams of deionized water and the slurry is then homogenized using an IKA ULTRA TURRAX T50 homogenizer operating at about 3,000-4,000 revolutions per minute (rpm). During homogenization about 28 grams of a flocculent mixture containing about 2.8 grams polyaluminum chloride mixture and about 25.2 grams 0.02 molar nitric acid solution is added to the slurry. Thereafter, the 2 L glass reactor is transferred to a heating mantle; the rpm is set to 230 and heated to a temperature of about 50° C. where samples are taken to determine the average toner particle size. Once the particle size of about 4.8 microns as measured with a Coulter Counter is achieved, 106 grams of latex emulsion (lot. SDC-EP02, 41% solids, Table 1) similar to that in the core was added to the reactor over a 5 minute time span. The reactor is then heated to 52° C. When the toner particle size reaches 5.6-6 microns, freezing begins with the pH of the slurry being adjusted to 3.3 using a 4% NaOH solution. The reactor RPM is decreased to 220 followed by the addition of 3.74 grams of a chelating agent (Versene100) and more NaOH solution until pH reaches 4.5. The reactor temperature is ramped to 96 C. Once at the coalescence temperature, the slurry is coalesced for about 1 hour until the particle circularity is between 0.955-0.960 as measured by the Flow Particle Image Analysis (FPIA) instrument. The slurry is then cooled. The final particle size was 5.96 microns, GSDv 1.19, GSDn 1.26 and a circularity of 0.959. The % yield and % coarse (>25 μm) are 91.9 and 2.0, respectively.

Example 6

Control Toner 1

Preparation of Black Styrene-Based Toner with Non-Fluorinated Surfactant Latex (Comparative)

A black EA styrene-acrylate toner was prepared at the 2 L Bench scale (155 g dry theoretical toner).

In a 2 L glass reactor, 209 grams of a latex emulsion comprised of polymer particles generated from the emulsion polymerization of styrene, butyl acrylate and beta carboxy ethyl acrylate (β-CEA) (lot. SDC-EP07, 41% solids), 58 grams of aqueous paraffin wax dispersion (lot. Paraffin N-539, 30% solids), 58 grams of Black pigment dispersion (lot. Nipex-35, 17.5% solids), and 10 grams of Cyan pigment dispersion (lot Sun PB15-3, 16% solids) are added to about 470 grams of deionized water and the slurry is then homogenized using an IKA ULTRA TURRAX T50 homogenizer operating at about 3,000-4,000 revolutions per minute (rpm). During homogenization about 28 grams of a flocculent mixture containing about 2.8 grams polyaluminum chloride mixture and about 25.2 grams 0.02 molar nitric acid solution is added to the slurry. Thereafter, the 2 L glass reactor is transferred to a heating mantle; the rpm is set to 230 and heated to a temperature of about 50° C. where samples are taken to determine the average toner particle size. Once the particle size of about 4.8 microns as measured with a Coulter Counter is achieved, 106 grams of latex emulsion (lot. SDC-EP02, 41% solids) similar to that in the core was added to the reactor over a 5 minute time span. The reactor is then heated to 52° C. When the toner particle size reaches 5.6-6 microns, freezing begins with the pH of the slurry being adjusted to 3.3 using a 4% NaOH solution. The reactor RPM is decreased to 220 followed by the addition of 3.74 grams of a chelating agent (Versene100) and more NaOH solution until pH reaches 4.5. The reactor temperature is ramped to 96 C. Once at the coalescence temperature, the slurry is coalesced for about 1 hour until the particle circularity is between 0.955-0.960 as measured by the Flow Particle Image Analysis (FPIA) instrument. The slurry is then cooled. The final particle size was 5.71 microns, GSDv 1.21, GSDn 1.25 and a circularity of 0.961. The % yield and % coarse (>25 μm) are 87.8 and 2.5, respectively.

As can be seen from Toner Example 1 and Control Toner 1, the percent yield and percent coarse (>25 μm) shows a 4.1% and 0.5% improvement, respectively.

Developer Performance Results

Both parent and toner with a particular additive package—RY50L hydrophobic silica from Nippon Aerosil, Inc., RX50 hydrophobic silica from Nippon Aerosil, Inc., STT100H surface treated with butyltrimethoxysiliane from Titan Koygo, X24 surface treated sol-gel silica and PTFE—were evaluated for bench charging, toner flow, blocking and dielectric loss. Results were compared to two toner controls, the production EA high gloss toner blended with the additive package a 35 um solution coated carrier and the production EA low melt toner blended with the additive package and a 35 um solution coated carrier. Note that these emulsion aggregate high gloss Control Toners 2 and 3 are here for reference, but typically lab toners do not match production performance, so the most critical comparison is between Toner Example 1 (inventive toner with fluorosurfactant) and Control Toner 1 (toner without fluorosurfactant).

Developers were prepared at 6% TC with 30 grams of carrier in a bottle, samples separately conditioned in A-zone at high humidity (28° C./85% relative humidity) and low humidity J-zone (21.1° C./10% RH), then mixed for 10' and 60' in a Turbula mixer as shown below to charge. Toner charge maintenance is the charge of the A-zone 60' charged material compared to the charge after leaving that developer in A-zone for 24 hrs and then 7 days without further mixing. So it is a measure of the stability of the charge in the developer to prolonged resting in A-zone at high humidity.

The toner charge was measured in the form of q/d, the charge to diameter ratio. The q/d was measured using a charge spectrograph with a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

The toner charge per mass ratio (Q/M) was also determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/M ratio.

Toner blocking was determined by measuring the toner cohesion at elevated temperature above room temperature. Toner blocking measurement is completed as follows: two grams of additive toner is weighed into an open dish and conditioned in an environmental chamber at the specified elevated temperature and 50% relative humidity. After about 17 hours the samples are removed and acclimated in ambient conditions for about 30 minutes. Each re-acclimated sample is measured by sieving through a stack of two pre-weighed mesh sieves, which are stacked as follows: 1000 μm on top and 106 μm on bottom. The sieves are vibrated for about 90 seconds at about 1 mm amplitude with a Hosokawa flow tester. After the vibration is completed the sieves are reweighed and toner blocking is calculated from the total amount of toner remaining on both sieves as a percentage of the starting weight. Thus, for a 2 gram toner sample, if A is the weight of toner left the top 1000 μm screen and B is the weight of toner left the bottom 106 μm screen, the toner blocking percentage is calculated by: % blocking=50 (A+B).

Also measured was dielectric loss in a custom-made fixture connected to an HP4263B LCR Meter via shielded 1 meter BNC cables. To ensure reproducibility and consistency, one gram of toner (conditioned in C-zone 24 h) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric and dielectric loss were determined by measuring the capacitance (Cp) and the loss factor (D) at 100 KHz frequency and 1 VAC. The measurements were carried out under ambient conditions. The dielectric constant was calculated as:

$$E' = [Cp\ (\text{pF}) \times \text{Thickness (mm)}]/[8.854 \times A\text{effective } (\text{m}^2)]$$

Here 8.854 was just the vacuum electrical permittivity epsilon(o), but in units that take into account the fact that Cp was in picofarads, not farads, and thickness was in mm (not meters). Effective was the effective area of the sample. Dielectric loss was =E*Dissipation factor, which was how much electrical dissipation there was in the sample (how leaky the capacitor was). We multiplied this by 1000 to simplify the values. Thus, a reported dielectric loss value of 70 indicated a dielectric loss of $70 \times 10^{-3}$, or 0.070.

Results are summarized in Tables 1 and 2 below.

TABLE 1

| Particle | 10' charging with additive package, 6 pph TC | | | | | |
|---|---|---|---|---|---|---|
| | A-zone | | J-zone | | RH ratio | |
| ID | Az 10' Q/d | Az 10' Q/m | Jz 10' Q/d | Jz 10' Q/m | 10' RH Q/d | 10' RH Q/m |
| Control Toner 2 | 7.4 | 45 | 11.6 | 77.2 | 0.64 | 0.58 |
| Control Toner 3 | 8.3 | 40 | 15.9 | 77.5 | 0.54 | 0.52 |
| Control Toner 1 | 8.9 | 46 | 15.6 | 76.4 | 0.57 | 0.60 |
| Toner Example 1 | 8.2 | 44 | 15.8 | 78.2 | 0.52 | 0.57 |

| Particle | 60' charging with additive package, 6 pph TC | | | | | | Charge maintenance | | Hosokawa Flow |
|---|---|---|---|---|---|---|---|---|---|
| | A-zone | | J-zone | | RH ratio | | | | |
| ID | Az 60' Q/d | Az 60' Q/m | Jz 60' Q/d | Jz 60' Q/m | 60' RH Q/d | 60' RH Q/m | 24 h C M | 7 d C M | % cohesion |
| Control Toner 2 | 6.5 | 34.4 | 12.2 | 70.1 | 0.53 | 0.49 | 98 | 92 | 8 |
| Control Toner 3 | 7.2 | 30.2 | 14.0 | 64.9 | 0.51 | 0.47 | 92 | 84 | 8 |
| Control Toner 1 | 6.3 | 29.0 | 12.9 | 61.9 | 0.49 | 0.47 | 97 | 92 | 5 |
| Toner Example 1 | 5.4 | 27.2 | 13.2 | 60.0 | 0.41 | 0.45 | 103 | 5 | 6 |

TABLE 2

| Particle | 10' Parent charging, 6 pph TC | | | | | |
|---|---|---|---|---|---|---|
| | A-zone | | J-zone | | RH ratio | |
| ID | Az Parent Q/d | Az Parent Q/m | Jz Parent Q/d | Jz Parent Q/m | RH Q/d | RH Q/m |
| Control Toner 2 | 6.7 | 42 | 16.9 | 120 | 0.40 | 0.35 |
| Control Toner 3 | 8.0 | 31 | 20.4 | 89 | 0.39 | 0.35 |
| Control Toner 1 | 7.4 | 41 | 36.6 | 154 | 0.20 | 0.26 |
| Toner Example 1 | 7.6 | 38 | 28.9 | 131 | 0.26 | 0.29 |

TABLE 2-continued

| Particle ID | dielectric loss E"X1000 Loss | dielectric loss E' Constant | q/m to q/d ratio A-zone | q/m to q/d ratio J-zone | Blocking Onset Temp (deg C.) |
|---|---|---|---|---|---|
| Control Toner 2 | 42 | 3.84 | 6.34 | 7.07 | 58.0 |
| Control Toner 3 | 32 | 3.32 | 3.89 | 4.35 | 54.1 |
| Control Toner 1 | 16 | 2.76 | 5.47 | 4.20 | 56.1 |
| Toner Example 1 | 34 | 3.57 | 4.98 | 4.53 | 56.3 |

Figure 2:
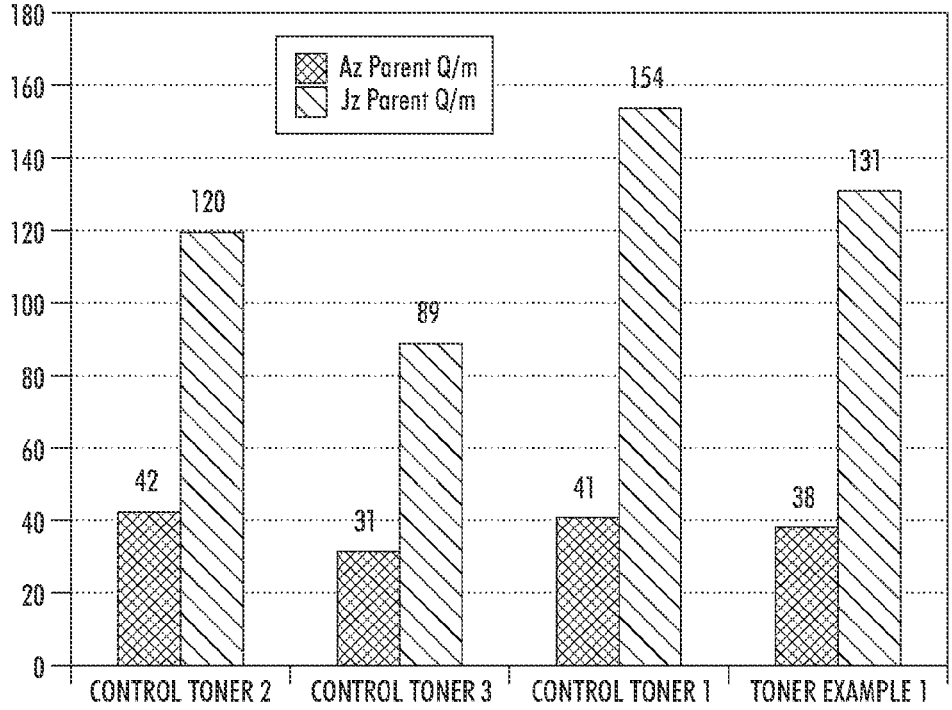
FIG. 2 is another graph illustrating parent charging of control toners as compared to an inventive toner made according to the present embodiments.

FIGS. 1-2 shows parent charging. For comparative Control Toner 1, charge is too high in J-zone, which is reduced by the addition of the fluorosurfactant (as shown in Toner Example 1), much closer to Control Toner 3. Higher J-zone parent charge is a large risk for high charge on aging due to low toner age in machine tests. The fluorosurfactant avoids this risk. A-zone charge for all is similar to controls. Control Toner 2 is a high gloss styrene acrylate-based toner and Control Toner 3 is a low melt polyester-based toner.

Figure 3:
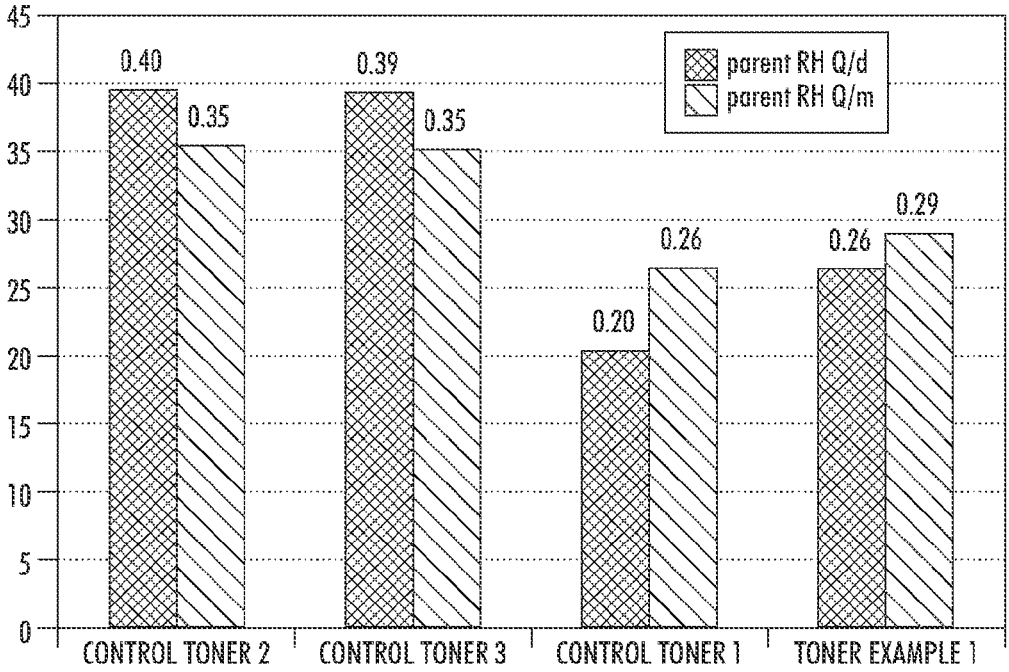
FIG. 3 is a graph illustrating parent toner relative humidity (RH) ratio of control toners as compared to an inventive toner made according to the present embodiments.

The parent toner relative humidity (RH) ratio is shown in FIG. 3 below. Again, there is a significant improvement in the RH ratio of Toner Example 1 as compared to comparative Control Toner 1, much closer to the reference Control Toner 3.

Figure 4:
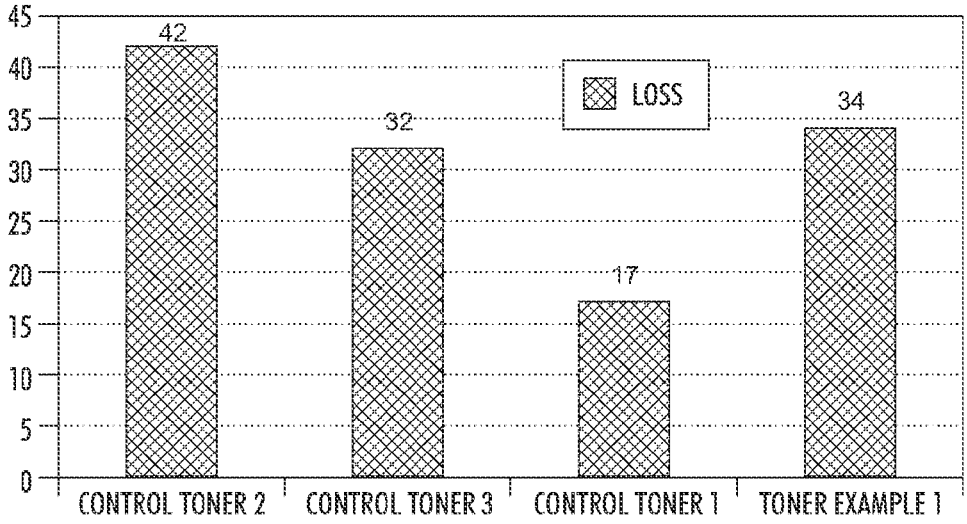
FIG. 4 is a graph illustrating parent dielectric loss of control toners as compared to an inventive toner made according to the present embodiments.

FIG. 4 shows the parent dielectric loss. While Toner Example 1 was higher loss than Control Toner 1, it is similar to Control Toner 3 so this is not an issue.

Figure 5:
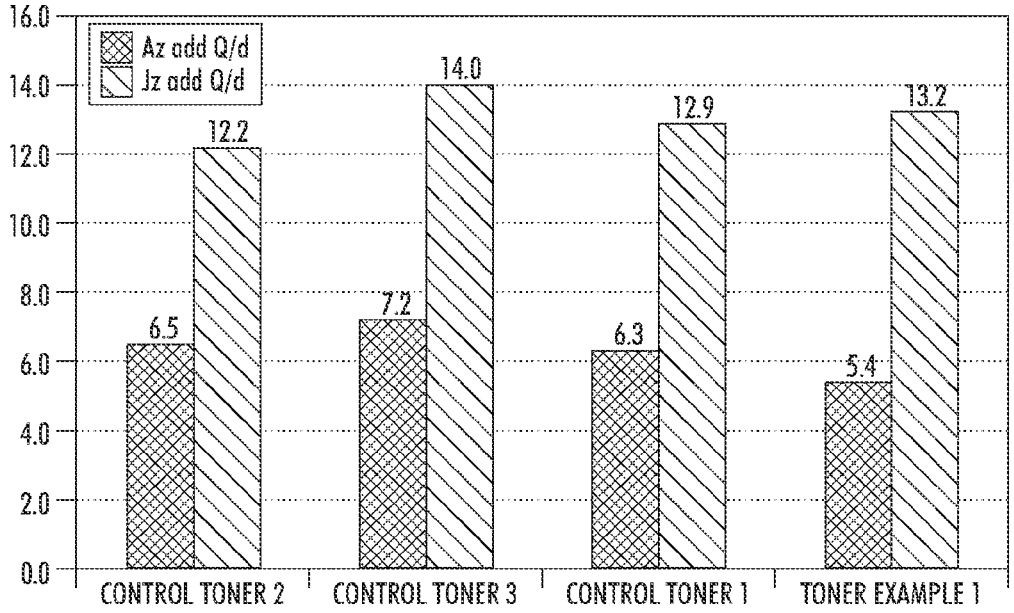
FIG. 5 is a graph illustrating a blend toner charge at 60' mixing of control toners as compared to an inventive toner made according to the present embodiments.
Figure 6:
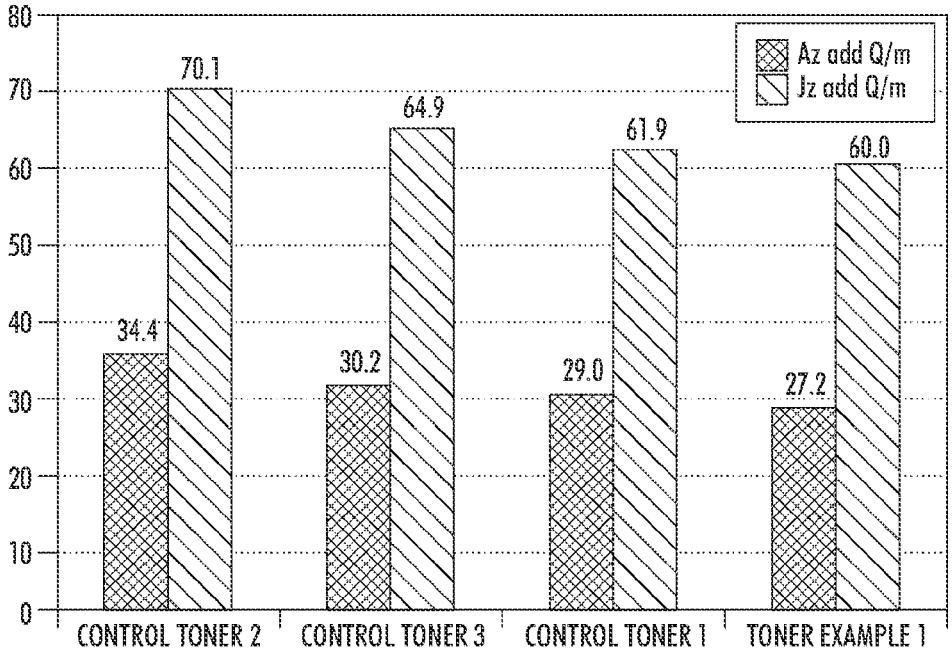
FIG. 6 is another graph illustrating a blend toner charge at 60' mixing of control toners as compared to an inventive toner made according to the present embodiments.

FIGS. 5-6 show the blend toner charge at 60' mixing. All toners are quite similar, and Toner Examples 1 and 2 are very similar, within error.

Figure 7:
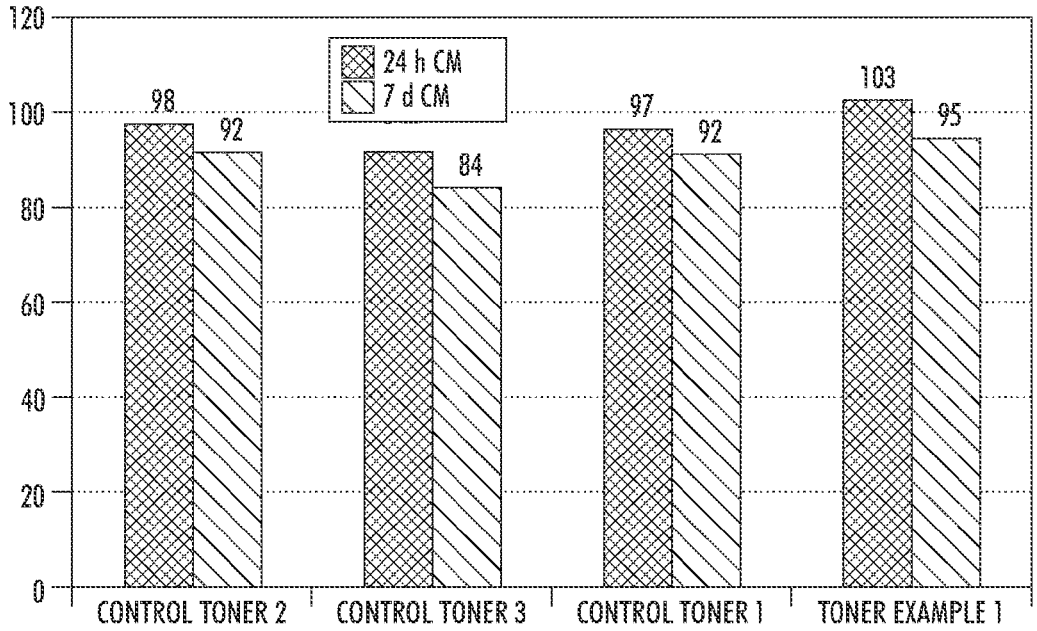
FIG. 7 is a graph illustrating blended toner charge maintenance of control toners as compared to an inventive toner made according to the present embodiments.

FIG. 7 shows the blended toner charge maintenance, which shows Toner Example 1 having significant improvements as compared to the comparative Control Toner 1.

Figure 8:
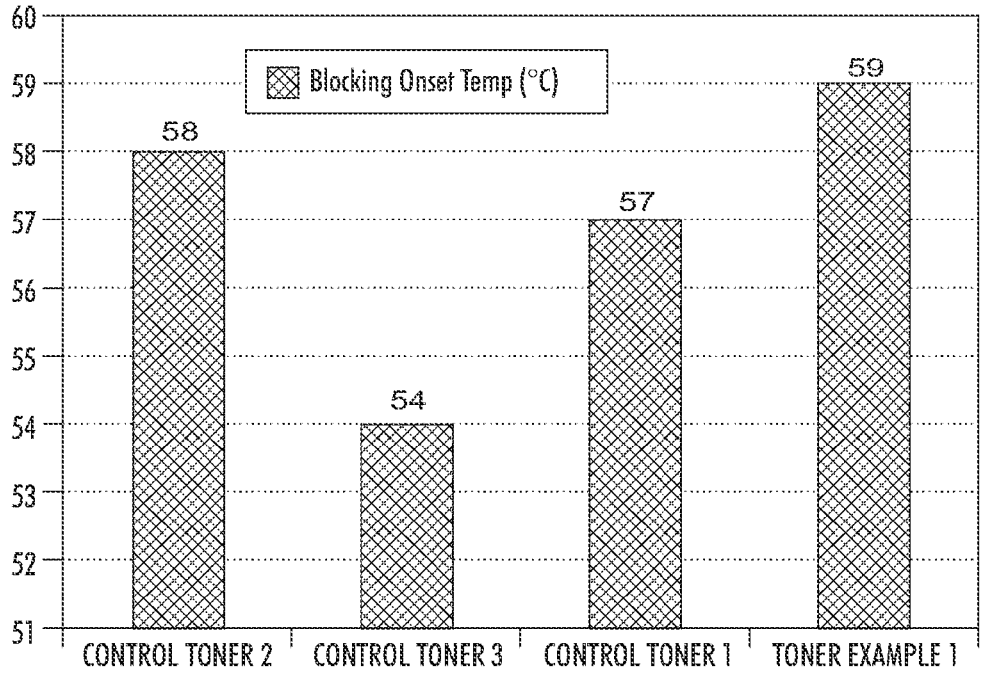
FIG. 8 is a graph illustrating blended toner blocking of control toners as compared to an inventive toner made according to the present embodiments.

FIG. 8 is a graph illustrating blended toner blocking of control toners as compared to Toner Example 1 and shows excellent blocking resistance similar to, if not better than, the control toners.

The above performance results, while evaluated on styrene toners, are expected to be similar for polyester toners.

Examples 7 and 8 are prophetic examples of a polyester latex sample comprising the fluorinated surfactant and a polyester toner made from the same.

Example 7

Phase Inversion Emulsification of Amorphous Polyester Resin with 0.75% Fluorinated Surfactant (Latex Sample 4) and Crystalline Polyester Resin (No Fluorinated Surfactant)

An emulsion amorphous polyester resin is prepared by dissolving 100 grams of this resin in 100 grams of methyl ethyl ketone, and 3 grams of isopropanol. The mixture resulting is then heated to 40° C. with stirring, and to this mixture are added dropwise 5.5 grams of ammonium hydroxide (10 percent aqueous solution), after which 200 grams of water containing 10.33 grams of Chemguard S-764P (Fluorinated surfactant, 22% active, 33% solids) are added dropwise over a 30 minute period. The resulting dispersion is then heated to 80° C., and the organic solvent of methyl ethyl ketone was distilled off to result in a 41.5 percent solid dispersion of amorphous polyester in water. The polyester emulsion particles are measured to be 180 nanometers in size diameter.

An aqueous emulsion of the crystalline polyester resin poly(1,9-nonylene-succinate) is prepared by dissolving 100 grams of this resin in ethyl acetate (600 grams). The mixture is then added to 1 liter of water containing 2 grams of sodium bicarbonate, and homogenized for 20 minutes at 4,000 rpm, followed by heating to 80° C. to 85° C. to distill off the ethyl acetate. The resultant aqueous crystalline polyester emulsion have a solids content of 35.17 percent by weight and measured to have a particle size of 155 nanometers.

Example 8

Toner Example 2

Preparation of Black Polyester Toner with Fluorinated Surfactant

A polyester toner is prepared by forming a core of 6.8 percent of a crystalline polyester resin, 6.5 percent of black pigment dispersion (lot. Nipex-35, 17.5% solids), 9 percent of wax and 52.6 percent of an amorphous polyester resin, and then aggregated onto the core an additional 28 percent of the amorphous polyester resin to form a shell.

Into a 2 liter glass reactor equipped with an overhead mixer are added 85.7 grams of the amorphous polyester resin emulsion of Example 7, 13.81 grams of the crystalline polyester resin emulsion of Example 7, 44.57 grams of the black pigment dispersion (lot. Nipex-35, 17.5% solids), and 21.58 grams of a polyethylene wax aqueous dispersion (30 percent by weight) which is generated using P725 polyethylene wax available from Baker-Petrolite with a weight average molecular weight of 725 grams/mole, and a melting point of 104° C., together with 2 percent by weight of sodium dodecylbenzenesulfonate surfactant, and wherein the particle size of the aqueous dispersion solids is 200 nanometers.

Separately, 0.75 gram of $Al_2(SO_4)_3$ (27.85 weight percent) is added to the above mixture as the flocculent with homogenization. The resulting mixture is then heated to 32.8° C. to aggregate the particles while stirring at 300 rpm. The particle size is monitored with a Coulter Counter until the core reached a volume average particle size of 4.44 microns with a GSD volume of 1.23, and then 47.35 grams of the amorphous resin emulsion of Example 7 are added as a shell material, resulting in core-shell structured particles with an average particle size of 5.40 microns, and GSD volume of 1.21. Thereafter, the pH of the obtained reaction slurry is increased from about 3 to 7.98 by adding 4 weight percent of a NaOH solution followed by the addition of 2.69 grams of EDTA (39 weight percent) to freeze or prevent toner growth.

After freezing, the reaction mixture is heated to 80.6° C., and the pH is reduced to 7.46 by adding an acetic acid/sodium acetate (HAc/NaAc) buffer solution (pH 5.7) for coalescence. The toner resulting is quenched into water after coalescence, resulting in a final toner particle size (diameter throughout) of 5.90 microns, a GSD volume of 1.27, and GSD number 1.26. The toner slurry is then cooled to room temperature, separated by sieving (25 micron screen), filtration, followed by washing, and freeze dried.

There results a toner comprised of 80.7 percent by weight of the above amorphous polyester resin containing 0.75% fluorosurfactant, 6.8 percent of the above crystalline polyester resin, 6.5 percent of the above black pigment, and 9 percent of the above polyethylene wax, based on the total solids.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

What is claimed is:

1. A toner composition comprising:

toner particles having a core, wherein the core comprises one or more polyester resins, a colorant, a wax, and one or more additives incorporated into the core, the one or more additives comprising a fluorinated surfactant;

wherein the fluorinated surfactant is represented by the formula:

$$CF_3—(CF_2)_x—(CH_2)_y—Z$$

wherein Z is a water solubilizing group of either organic or inorganic character, x is an integer of from 2 to 17, y is an integer of from 2 to 4, and the fluorinated surfactant is cationic anionic, amphoteric or zwitterionic.

2. The toner composition of claim 1, wherein the fluorinated surfactant is of the phosphate ester type.

3. The toner composition of claim 1, wherein the fluorinated surfactant is present in the toner composition in an amount of from about 0.001 to about 5 percent by weight of the resin.

4. The toner composition of claim 1, wherein the fluorinated surfactant has short carbon chains having no more than 18 carbons.

5. The toner composition of claim 1, wherein the fluorinated surfactant is an anionic surfactant.

6. The toner composition of claim 1, wherein an amount of fluorine on the surface of the toner particle is from about $5\times10^{-7}$ atom % to about 0.8 atom %.

7. The toner composition of claim 1, wherein the resin is a crystalline polyester resin selected from the group consisting of poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(ododecylene-adipate), poly(ethylene-glutarate), poly(propylene-glutarate), poly(butylene-glutarate), poly(pentylene-glutarate), poly(hexylene-glutarate), poly(octylene-glutarate), poly(nonylene-glutarate), poly(decylene-glutarate), poly(undecylene-glutarate), poly(dododecylene-glutarate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(ododecylene-succinate), poly(ethylene-pimelate), poly(propylene-pimelate), poly(butylene-pimelate), poly(pentylene-pimelate), poly(hexylene-pimelate), poly(octylene-pimelate), poly(nonylene-pimelate), poly(decylene-pimelate), poly(undecylene-pimelate), poly(ododecylene-pimelate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dododecylene-sebacate), poly(ethylene-azelate), poly(propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(ododecylene-azelate), poly(ethylene-dodecanoate), poly(propylene-dodecanoate), poly(butylene-dodecanoate), poly(pentylene-dodecanoate), poly(hexylene-dodecanoate), poly(octylene-dodecanoate), poly(nonylene-dodecanoate), poly(decylene-dodecanoate), poly(undecylene-dodecanoate), poly(ododecylene-dodecanoate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), poly(undecylene-fumarate), poly(dododecylene-fumarate), copoly-(butylene-fumarate)-copoly-(hexylene-fumarate), copoly-(ethylene-dodecanoate)-copoly-(ethylene-fumarate) and mixtures thereof.

8. The toner composition of claim 1, wherein the resin is an amorphous polyester resin selected from the group consisting of poly(1,2-propylene-diethylene)terephthalate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and mixtures thereof.

9. The toner composition of claim 1 being an emulsion aggregate toner composition.

10. The toner composition of claim 9, wherein the fluorinated surfactant is used in forming a latex for the emulsion aggregate toner.

11. The toner composition of claim 1, wherein the toner composition has a toner charge of from about 10 to about 100 μC/g.

12. The toner composition of claim 1, wherein the crystalline and amorphous resin is present in the toner composition in an amount of from about 65 to about 95 percent by weight of the toner composition.

13. The toner composition of claim 1, wherein the colorant is present in the toner composition in an amount of from about 0.01 to about 40 percent by weight of the toner composition.

14. The toner composition of claim 1, wherein the wax is present in the toner composition in an amount of from about 0.5 to about 25 percent by weight of the toner composition.

15. A developer comprising:

a toner composition; and a toner carrier, wherein the toner composition comprises toner particles having a core, wherein the core comprises one or more polyester resins, a colorant, a wax, and one or more additives incorporated into the core, the one or more additives comprising a fluorinated surfactant;

wherein the fluorinated surfactant is a perfluorinated compound represented by the formula:

$$CF_3—(CF_2)_x—(CH_2)_y—Z$$

wherein Z is a water solubilizing group of either organic or inorganic character, x is an integer of from 2 to 17, y is an integer of from 2 to 4, and the fluorinated surfactant is cationic anionic, amphoteric or zwitterionic.

16. A method of making a toner composition comprising generating a first latex emulsion comprising one or more polyester resins, water and a fluorinated surfactant;

wherein the fluorinated surfactant is a perfluorinated compound represented by the formula:

$$CF_3—(CF_2)_x—(CH_2)_y—Z$$

wherein Z is a water solubilizing group of either organic or inorganic character, x is an integer of from 2 to 17, y is an integer of from 0 to 4, and the perfluorinated compound is anionic, amphoteric or zwitterionic;

generating a colorant dispersion comprising a colorant, water and an ionic or nonionic surfactant;

blending the first latex emulsion and colorant dispersion together with an optional wax to form a slurry;

adding a coagulant to the slurry;

heating the slurry to a temperature below or about equal to the glass transition temperature (Tg) of the amorphous polyester resin to form aggregated particles;

adding a second latex emulsion comprising an amorphous polyester resin suspended in an aqueous phase to the aggregated particles to form a shell over the aggregated particles;

freezing aggregation of the aggregated particles in the slurry at a desired aggregated particle size; and further heating the aggregated particles in the slurry to a temperature about equal to or above the glass transition temperature (Tg) of the amorphous polyester resin to coalesce the aggregated particles into toner particles.

17. The method of claim 16, wherein the one or more polyester resins are selected from the group consisting of an amorphous polyester resin, a crystalline polyester resin and mixtures thereof.

18. The method of claim 16, wherein the coalescence of the aggregated particles is further performed by changing the pH of the slurry.

* * * * *